United States Patent [19]

Sweatt

[11] Patent Number: 4,750,391

[45] Date of Patent: Jun. 14, 1988

[54] OPENER FOR REMOVING CHAMPAGNE-TYPE CORKS

[75] Inventor: Stanley I. Sweatt, Downey, Calif.

[73] Assignee: Stan Dee, Incorporated, Downey, Calif.

[21] Appl. No.: 848,382

[22] Filed: Apr. 4, 1986

[51] Int. Cl.[4] ..... B67B 7/06

[52] U.S. Cl. ..... 81/3.37; 81/3.29

[58] Field of Search ..... 81/3.36, 3.37, 3.07, 81/3.08, 3.25, 3.31, 3.33, 3.29, 3.4, 3.41, 3.44; D8/18, 33, 39, 40, 42

[56] References Cited

U.S. PATENT DOCUMENTS

| | | | |
|---|---|---|---|
| 695,235 | 3/1902 | Riolet | 81/3.37 |
| 2,335,777 | 11/1943 | Marcellus | 81/3.37 |
| 4,598,613 | 7/1986 | Baum | 81/3.37 |
| 4,606,245 | 8/1986 | Veverka et al. | 81/3.36 |

FOREIGN PATENT DOCUMENTS

| | | | |
|---|---|---|---|
| 0164955 | 12/1985 | European Pat. Off. | 3.07/ |
| 2644647 | 4/1978 | Fed. Rep. of Germany | 81/3.29 |

*Primary Examiner*—Debra S. Meislin
*Attorney, Agent, or Firm*—Lewis B. Sternfels

[57] ABSTRACT

An opener (10) for removing a cork (36) from a champagne-type bottle (12)in a generally straight line comprises a frame (20, 22) contactable with the bottle by a pivotable annulus (60) so that the opener can be maintained generally immobile with respect to the bottle during removal of the cork. A pair of tongs (32) are slidable in channels within arms (30) so that the tongs may be moved towards and from the mouth of the bottle. The tongs are pivotable with respect to one another so that, when they are moved upwardly from the mouth of the bottle by a rack (46) engaging gear segments (50) on handles (54), the tongs can pivot towards one another to secure better engagement with the cork to effect movement of the tongs and the cork engaged thereby in a direction away from the bottle. The tongs are also pivotable to accommodate corks of different sizes, and the wires binding the cork to the bottle.

14 Claims, 2 Drawing Sheets

Fig. 1.
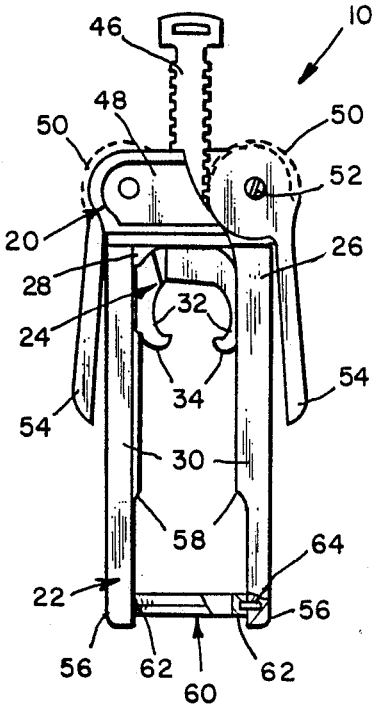
Fig. 2.
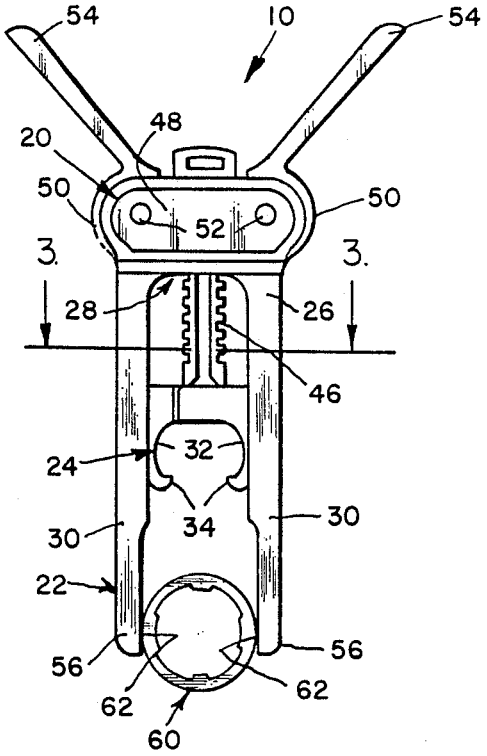
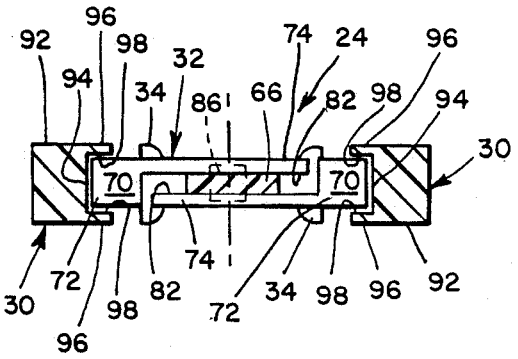
Fig. 3.
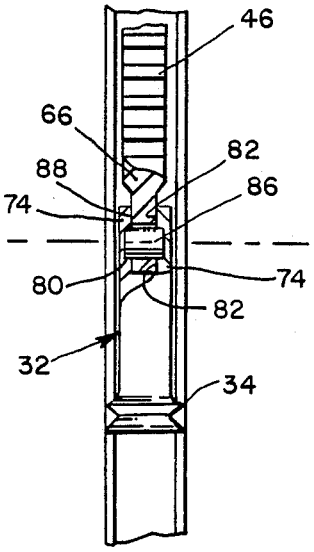
Fig. 4.

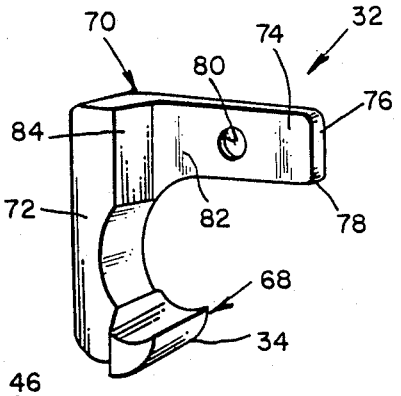
Fig. 5.
Fig. 7.
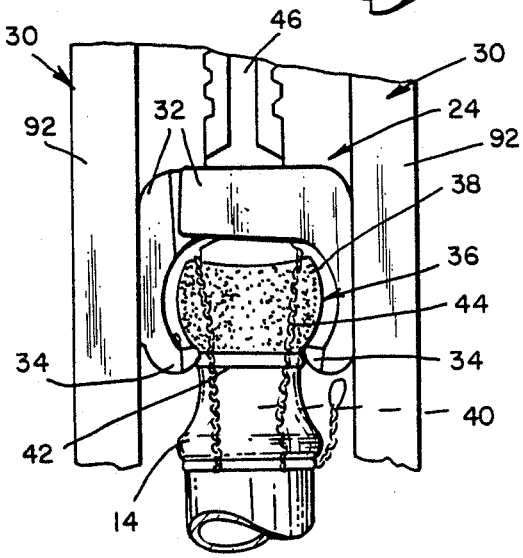
Fig. 6.
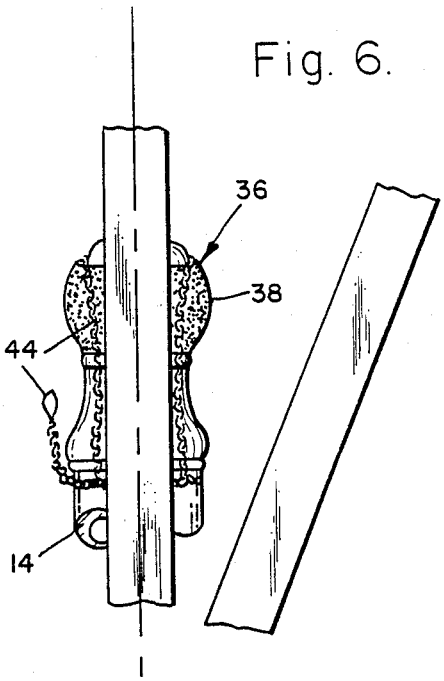
Fig. 8.
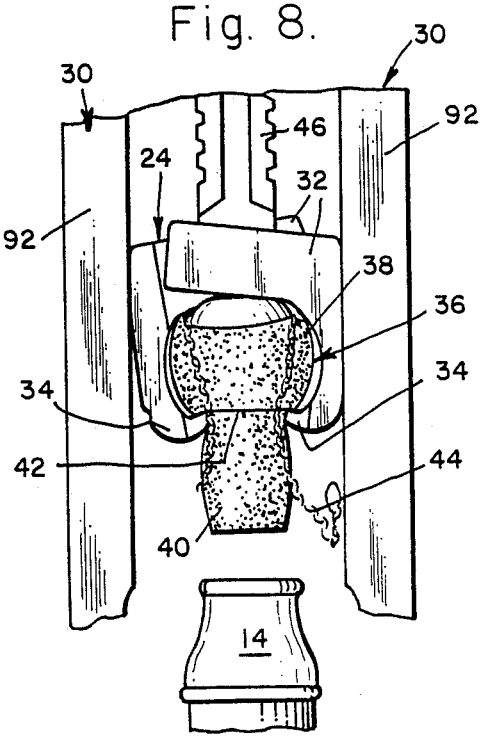
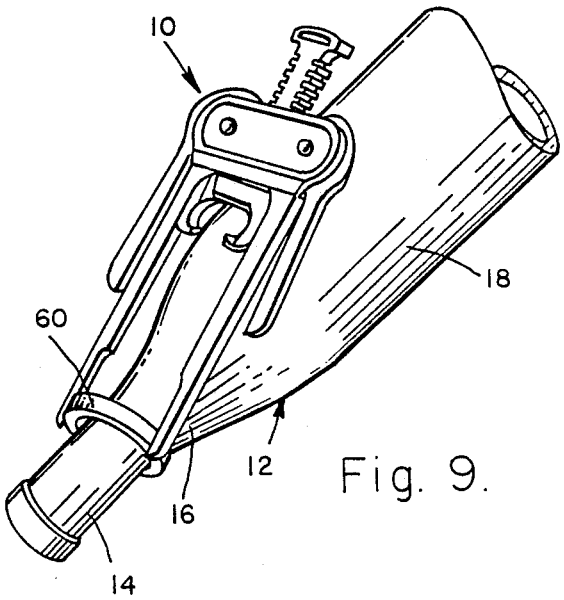
Fig. 9.

OPENER FOR REMOVING CHAMPAGNE-TYPE CORKS

BACKGROUND OF THE INVENTION

The present invention relates to a bottle opener and, in particular, to an opener of corks from a champagne-type bottle along with any safety wires which may be present.

Openers for the pulling of corks from bottles is a well-developed art, utilizing a large variety of constructions. Some provide a corkscrew which is screwed into the cork which is then pulled from the bottle. A much preferred pulling mechanism for the corkscrew utilizes the well-known rack and gear combination such as is exemplified by U.S. Pat Nos. 1,753,026, 2,115,289 and 4,063,473. These have the advantage of straight-line removal of the cork from the bottle with small effort. The disadvantages of a corkscrew, with respect to a champagne-type cork are obvious. It is difficult to screw the corkscrew into the cork, especially when the cork is under pressure. The pressure within the bottle results in a lack of control in the cork-removing process inasmuch as the operator's hands are on the gear-pivoting handles in which a sudden removal of the cork may cause the entire mechanism to fly from the operator's hands. There is no room on the lip of the bottle opening or mouth on which the pulling tool may be positioned.

Accordingly, other constructions specifically adapted for removing champagne-type corks are illustrated in U.S. Pat. Nos. 3,722,327 and 4,387,609. Both constructions are similar in that they pry the champagne cork from the bottle. The former actually grips the cork's head in a pliers-like grip while the latter has tines whose narrow edges are slid under the head of the cork. The former assumedly prevents uncontrolled movement of the cork because it actually grips the cork while the latter does not, so that the cork will fly in an uncontrolled manner when removed from the bottle's opening.

Other champagne cork removal mechanisms are shown in U.S. Pat. Nos. 2,761,338 and 3,800,345. These patents are common to each other in that they use a screw mechanism, in conjunction with fittings under the champagne cork's head, to lift the corks from their bottles. Both also have a means for preventing uncontrolled movement of a cork from the bottle, once it has been removed from the bottle's neck.

These latter four constructions have several disadvantages. They may not fit on every lip of a bottle or may not provide the proper leverage to withdraw the cork in a straight line manner. The methods illustrated in U.S. Pat. Nos. 3,722,327 and 4,387,609 can place bending stresses on the cork and could possibly cause the cork to break. Not all corks have the same size, and they are differently constructed. The above patents are not all capable of adjusting to differences in size and construction of such corks and even of the many bottles, for example, those containing champagne. Some of the cork removal tools are also mechanically complicated and relatively expensive.

Serious safety problems also exist in the opening of bottles of champagne and other carbonated beverages which are sealed by a cork. To prevent the cork from becoming loosened from the bottle, except when it is desired to open the bottle, a security wire is placed about the cork and secured to the bottle. When it is desired to open the bottle, the retaining wire is unwound, loosened from the cork and removed from the bottle and discarded. During this time, the bottle and the cork may be briefly left unattended. Unless care is taken, the pressure from carbonization within the bottle may be sufficient to eject the cork explosively therefrom and into a person or an object resulting in possible serious injury or harm thereto.

SUMMARY OF THE INVENTION

The present invention overcomes or avoids many of these disadvantages and drawbacks and, in some instances, utilizes some of their advantages. In general, the present invention utilizes a tong-like construction, in which the raising of a cork-engaging mechanism with respect to a cork causes the tongs to pivot into engagement with the cork, grasp it and lift it from the bottle. The corking-engaging mechanism is slidably mounted in a supporting frame. The frame is terminated preferably by a pivotable ring, which is spaced downwardly from the cork-engaging mechanism, and contacts the sloping shoulders of the bottle beneath its mouth. A lifting mechanism is coupled between the cork-engaging mechanism and the frame for enabling the lifting of the cork-engaging mechanism away from the ring and, therefore, away from the bottle.

Because a pair of tongs are used in the preferred embodiment, their pivotability enables them to adapt themselves to various sizes of corks and, in addition, to the safety wires retaining the cork to the bottle. Thus, the opener need be placed on the bottle with the cork-engaging mechanism pivoted slightly to one side of the cork, so that the cork-engaging mechanism with its tongs may be slid underneath the head of the cork, at which point, the safety wires may be then loosened so that the entire cork and wires may be lifted away from the bottle. Thereafter, the cork and the opener may be pivoted away from the bottle so that champagne may be poured from the bottle.

Several advantages are derived from this construction. Contact with the bottle is facilitated even though the head of the cork may overlap the bottle's mouth which would prevent contact of prior art openers with the bottle. The use of the cork-engaging mechanism enables it to be configured so as to provide the greatest contact with the cork and, consequently, to distribute the upward force thereon to the greatest possible extent; thus, localized stresses on the cork are avoided. Furthermore, the mechanism is self-adjusting to enable the removal tool to accommodate itself in a simple manner to different cork sizes. Removal of the cork is in a straight-line fashion directly out of the bottle's mouth, without exerting bending or other cork deformation stresses on the shank of the cork. In this respect, a linearly operable lifting mechanism is preferred to provide better control and to ensure straight-line movement of the cork. In addition, by spacing the terminus from the cork-engaging mechanism and, moreso, by utilizing a pivotable ring, the opener can be accommodated to bottles having different neck sizes and can also be swung away from the bottle's mouth without removing the opener from the bottle. Pivoting also permits the opener to be flat for storage and packaging. Removal of the cork without first needing to remove the cork-retaining wire adds to opening of the bottle with safety.

Other aims and advantages, as well as a more complete understanding of the present invention, will appear from the following explanation of exemplary embodiments and the accompanying drawings thereof.

BRIEF DESCRIPTION OF THE DRAWINGS

FIG. 1 is a front elevational view of the invention in partial cross-section, with the opener in closed position;

FIG. 2 is a view similar to that of FIG. 1, but showing the opener positioned in readiness for grasping a cork;

FIGS. 3 and 4 respectively a top view in partial cross-section, and a cross-sectional view taken along lines 4—4 of FIG. 3;

FIG. 5 is a perspective view of a tong used to grip the cork;

FIG. 6 is a view showing how the cork-engaging mechanism is pivoted into engagement with the cork;

FIGS. 7 and 8 respectively illustrate how the cork is first engaged by the tong-like construction and then for removing the cork from the bottle; and FIG. 9 is a perspective view of the cork-engaging mechanism placed on a bottle of champagne and swiveled back from the bottle's mouth after removal of the cork therefrom, in readiness for pouring of champagne.

DESCRIPTION OF THE PREFERRED EMBODIMENTS

Accordingly, as shown in FIGS. 1, 2 and 9, a champagne-type bottle opener 10 is positionable about a bottle 12 (see FIG. 9). The bottle is illustrated as having a mouth 14 and sloping shoulders 16 extending downwardly and spaced from the mouth. Shoulders 16 blend into a main body 18 of the bottle. Opener 10 is provided with a cork-engaging upper portion 20 and a bottle-engaging lower portion 22 to define a frame. The cork-engaging portion is disposed to be centered about the bottle's neck or mouth, while portion 22 is positionable about the bottle's sloping shoulders. The particular point of contact of portion 22 with the bottle's shoulders has a spacing from the engagement of portion 20 with the cork and this spacing constitutes an important part of the invention. Portion 20 includes a cork-engaging mechanism 24, which is likewise spaced from that part of portion 22 which contacts the bottle's shoulders.

Upper portion 20 includes a support 26 having an upwardly extending opening 28. A pair of arms 30 extends downwardly from support 26 and merges into bottom portion 22, to provide the necessary spacing between the cork-engaging mechanism and the bottle's shoulder contacting part of portion 22.

Cork-engaging mechanism 24 includes a pair of tongs 32 having cork-engaging ledges 34, and will be described in greater specificity in conjunction with FIGS. 3–5. The ledges are adapted to engage a cork 36, see also FIGS. 6–8, which includes a large head 38 and a shank 40 which extends into the mouth of the bottle. A connecting underside 42 connects head 38 with shank 40. Conventionally, cork 36 is secured to the bottle by a safety wire 44. Tong ledges 34 are disposed to engage underside 42 of the cork, as will be more fully explained with respect to the subsequent drawing figures. A toothed, flat rack 46 is secured to cradle mechanism 24 and extends through central opening 28.

As shown in FIGS. 1 and 2, formed also integrally with support 26 is a housing 48 which pivotally houses a pair of gear segments 50 by pivots 52. Gear segments 50 have teeth which engage the teeth of rack 46. Handles 54 extend from gear segments 50 so that downward movement of the handles raises the rack and cork-engaging mechanism 24 and the cork which is held thereby.

The pair of arms 30 extending from support 26 terminate in bottom portions 56 of lower portion 22. The bottom portions are bevelled or cut away at 58 for reception of a bottle shoulder contacting element, preferably configured as an annulus 60. Annulus 60 may have an internal configuration whose contact with the bottle's shoulders is extended to distribute the pressure on the shoulders. Annulus 60 includes portions 62 which are pivoted to bottom portions 56 by pins 64, so that the annulus may pivot substantially into the plane of opener 10 for packaging or storage of the opener when sold to or stored by a user, as illustrated in FIG. 2, or pivoted perpendicular to the opener's plane, as depicted in FIG. 1, for use of the opener to open the bottle.

At least as important as the above pivoting capability of annulus 60 is the ability of the opener to pivot about pins 64, as the fulcrum on the bottle's shoulder when annulus 60 is mounted thereon. This pivoting is used first in placing receptacle tongs 32 about the cork and in inserting ledges 34 underneath the cork (FIG. 6) and, second, as illustrated in FIG. 9, after the cork has been removed from the bottle's mouth, in swinging opener 10 about its annulus 60 from the bottle's mouth and neck without otherwise removing the opener from the bottle to permit champagne to be poured into a glass. In this latter operation, the cork may have been retained in mechanism 24 or removed therefrom.

FIGS. 3–5 illustrate the details of cork-engaging mechanism 24. As stated above, the cork-engaging mechanism includes a pair of tongs 32 which are pivoted to a central support or collar 66, from which toothed flat rack 46 extends. As best shown in FIG. 5, each half of tongs 32 includes a first cork-engaging portion 68 and a second pivoting portion 70. An intermediate portion 72 fixes portions 68 and 70 together. Intermediate portion 72 has a width which is less than ledge 34, for a purpose to be presently described.

Second portion 70 includes a segment 74 terminated by an end surface 76 having a rounded corner 78. A pivot hole 80 extends partially into segment 74 through an inner surface 82. Adjacent to segment 74 is a stop surface 84. As shown in FIGS. 3 and 4, central support or collar 66 has a pair of pivots 86 which extend from either side 88 of the support.

When tongs 32 and collar 66 are assembled, as shown in FIGS. 3 and 4, side surfaces 82 of each tong are placed against sides 88 of the collar. Pivots 86 extend into pivot holes 80 of each tong, so that the tongs may pivot with respect to support or collar 66. In addition, as shown in FIG. 3, end surfaces 76 of segments 74, as well as the end faces 90 of support 66 are spaced from respective surfaces 84 of tongs 32. This spacing is important; otherwise, pivoting of the tongs with respect to support 66 would not be possible. In support of such pivoting, rounded corners 78 of segments 74 provide additional clearance.

In order to maintain the assembled construction of cork-engaging mechanism 24, disassembly arms 30 of the frame, connecting upper and lower portions 20 and 22 together are formed as inwardly opening channels 92. Channels 92 are formed with a central portion 94 and a pair of bracketing legs 96, whose inner surfaces 98 provide a recess in which intermediate portions 72 of tongs 32 may slide. The distance between legs 96 of each channel 92 is sufficient to house intermediate portions 72, but are insufficiently spaced from one another to encompass ledge 34. Therefore, ledge 34 also provides a limit which encourages engagement of the cork-engaging mechanism with the cork. Because of the rigid construction of arms 30 and channels 92 with respect to the frame of the opener, tongs 32 are maintained in pivotable assembly with support 66.

In the use of the present invention, annulus 60 is placed over cork 36 and mouth 14 of the bottle, and the corkengaging mechanism and upper portion 20 of the opener are pivoted away from the bottle, as depicted in FIG. 6. The upper portion is then pivoted towards cork 36 so that ledges 34 slide under under surface 42 of the cork, as shown in FIG. 7. Because of the pivotability and spacing between the tongs, the tongs are able to encompass any size cork and its safety wires 44. After the cork has been engaged, wire 44 is released. Upon downward movement of handles 54 from the position of the opener illustrated in FIG. 2, rack 46 draws the tongs towards each other and into firm and secure holding engagement with cork 36 with a resultant so that the reaction force of annulus 60 against sloping shoulders 16 of the bottle cork and the loosened wires may be safely removed from the bottle, as shown in FIG. 8.

Thereafter, opener 10 may be pivoted back against the bottle, as shown in FIG. 9, to permit champagne to be poured from the bottle.

Because of the simplicity of the invention, it may be formed from a plastic material, utilizing conventional plastic forming machinery and configured into an attractive configuration for packaging for sales and and later for storage when not in use.

Although the invention has been described with reference to a particular embodiment thereof, it should be realized that various changes and modifications may be made therein without departing from the spirit and scope of the invention.

What is claimed is:

1. An opener for simultaneously removing a cork and accompanying safety wires from a champagne-type bottle in a generally straight line, in which the bottle has a main body, a mouth portion for retaining the cork and a sloping portion extending from the mouth portion to the main body, comprising:

a frame having a longitudinal axis and including an extension terminating in ends positionable adjacent to the bottle sloping portion;

means for engaging the cork and the safety wires;

means coupling said engaging means to said frame for urging said engaging means towards the cork and the wires and for effecting movement of said engaging means and the cork and wires engaged thereby in a generally straight line along the longitudinal axis, for removal of the cork and wires simultaneously from the bottle; and an annulus pivotally secured to said extension ends by pivot means having an axis of rotation extending perpendicular to and coplanar with the longitudinal axis, said annulus being positionable about the bottle and contactable with the sloping portion such that the axis of rotation passes through the bottle at the sloping portion, for enabling said frame and said engaging means to pivot with respect to said annulus and the bottle and thereby for enabling said cork-engaging means to pivot towards the mouth portion and about the cork and the wires prior to the removal of the cork, and for enabling said engaging means and the cork and wires to pivot away from the mouth portion after the removal of the cork and wires therefrom during contact of said annulus with the bottle.

2. An opener according to claim 1 in which said engaging means comprises a collar and a pair of tongs respectively having first and second portions spaced from one another by an intermediate portion, said first portions being disposed to grip the cork, means for pivotably securing said second portions to said collar, and said collar having a connection with said frame for enabling the movement.

3. An opener according to claim 2 in which:

the cork has a shank an enlarged head secured thereto to provide a connecting underside therebetween, and said first portions of said tongs respectively are configured as ledges engageable with spaced portions of said underside.

4. An opener according to claim 3 in which said frame comprises a pair of arms having facing channels which extend generally parallel to the lline, in which said intermediate portions of said tongs respectively are slidably engaged, and which restrict said tongs to pivoting within a plane defined by the plane of the longitudinal and rotational axes.

5. An opener according to claim 4 in which said ledeges have a greater width than that of said intermediate portions fitting within said channels, to prevent movement of said ledges into said channels, 6. An opener according to claim 2 in which said frame comprises a pair of arms having facing channels which extend generally parallel to the line, in which said intermediate portions of said tongs respectively are slidably engaged, and which restrict said tongs to pivoting within a plane defined by the plane of the longitudinal and rotational axes.

7. An opener according to claim 6 in which said collar includes a bar having parallel sides, and said second portions include segments positioned respectively on and against said parallel sides, and further including a pivot interconnecting said bar and said segments to enable said tongs to pivot with respect to said collar.

8. An opener according to claim 7 in which each of said segments is terminated by a flat surface, and each of said second portions includes a ledge facing towards and slightly spaced from said flat surface of said other second portion to enable pivotable rocking of said tongs both to accommodate orks of different sizes and to enable movement of said first portions into engagement with said cork.

9. An opener according to claim 8 in which:

the cork has a shank with an enlarged head secured thereto to provide a connecting underside therebetween, a protective wire is placed about the cork and secured to the bottle, said first portions of said tongs respectively are configured as ledges engageable with spaced portions of said underside, and said segments have a length sufficient to permit said intermediate portion and said ledges to extend about both the cork and the protective wire prior to its release from being secured to the bottle.

10. An opener for removing a cork from a champagne-type bottle having shoulders sloping outwardly from its mouth, comprising:

a frame having a longitudinal axis and including an extension having an end positionable adjacent the bottle shoulders;

means coupled to said frame and including a mechanism engageable with the cork for pulling the cork from the bottle in a generally straight line along the longitudinal axis; and means pivoted to said extension end by pivot mens having an axis of rotation extending perpendicular to and coplanar with the longitudinal axis, said pivoted means being contactable with the bottle shoulders such that the axis of rotation passes therethrough, for pivoting said frame and said cork-engaging means about the bottle and, thereby, for pivoting said cork-engaging mechanism into engagement with the cork during contact of said pivoted means with the bottle shoulders.

11. For use with a bottle sealed with a champagne-type cork in which the bottle has sloping shoulders extending downwardly and spaced from the bottle,s mouth and neck, an opener comprising:

means adapted tgo engage the cork;

an extension coupled to and extending from said cork-engaging means nd housing a longitudinal axis;

means pivoted to said extension by pivot means having an axis of rotation extending perpendicular to and coplanar with th ®longitudinal axis, said pivoted means being contactable with the bottle shoulders such that the axis of rotation passes therethrough and spaced from said cork-engaging means sufficient to permit said extension and said cork-engaging means to pivot about the bottle and said cork-engaging means to pivot towards and away from the mouth and neck when said pivoted means is in contat with the shoulders; and a lifting mechnism coupled between said cork-engaging means and said extension for lifting said cork-engaging means and the cork engaged thereby away from said pivoted means and the bottle mouth along the longitudinal axis.

12. An opener accoridng to claim 11 wherein safety wires secure the cork to the bottle, said cork-engaging means having a configuration to receive the wires.

13. For use with a bottle sealed with a champagne-type cork, in which the bottle has sloping shoulders extending downwardly and spaced from the bottle's mouth and neck, an opener comprising:

means adapted to engage the cork;

legs having a longitudinal axis and coupled to said cork-engaging means and having ends and an annulus whgich is pivoted to said leg ends by pivot means having an axis of rotation extending perpendicular to and coplanar with the longitudinal axis, said annulus surrounding and contacting the bottle shoulder and being spaced from said cork-engaging means sufficient to permit said legs and said cork-engaging means to pivot about said annulus towards and away from the mouth and neck when said annulus is in contact with the shoulders; and a lifting mechanism coupled between said cork-engaging means and said legs for lifting said corkengaging means and the cork engaged thereby away from said annulus and the bottle mouth along the longitudinal axis.

14. An opener according to claim 13 in which said cork-engaging means, said legs and said lifting mechanism have a substanially flat configuration lying generally in a plane defined by the plane of the longitudinal and rotational axes, and said annulus is pivotable into substantially the plane defined by the flat configuration.

* * * * *